US005183719A

United States Patent [19]

Yagi et al.

[11] Patent Number: 5,183,719

[45] Date of Patent: Feb. 2, 1993

[54] ELECTROPHOTOGRAPHIC MATERIAL HAVING AN AMORPHOUS SILICON PHOTOCONDUCTIVE LAYER, AN INTERMEDIATE LAYER AND A SURFACE LAYER

[75] Inventors: Shigeru Yagi; Yuzuru Fukuda; Taketoshi Higashi; Masaki Yokoi, all of Kanagawa, Japan

[73] Assignee: Fuji Xerox Co., Ltd., Tokyo, Japan

[21] Appl. No.: 738,520

[22] Filed: Jul. 31, 1991

[30] Foreign Application Priority Data

Aug. 1, 1990 [JP] Japan ..... 2-202495

[51] Int. Cl.[5] ..... G03G 5/14

[52] U.S. Cl. ..... 430/66; 430/84

[58] Field of Search ..... 430/66, 67, 64, 84

[56] References Cited

U.S. PATENT DOCUMENTS 5,008,170 4/1991 Karakida et al. ..... 430/66

5,008,172 4/1991 Rokutanzono et al. ..... 430/66

5,049,466 9/1991 Kyogoku et al. ..... 430/66

*Primary Examiner*—John Goodrow

*Attorney, Agent, or Firm*—Finnegan, Henderson, Farabow, Garrett and Dunner

[57] ABSTRACT

An electrophotographic light-sensitive material is disclosed, comprising an elecrically conductive substrate having thereon at least a photoconductive layer and a surface layer in this order, wherein the photoconductive layer is made mainly of amorphous silicon containing hydrogen, the surface layer is made of a high molecular weight material as a binder with an electrically conductive metal oxide powder dispersed therein, and at least one layer made mainly of amorphous silicon carbide, amorphous silicon nitride, amorphous silicon oxide or amorphous carbon each containing hydrogen is provided as an intermediate layer between the surface layer and the photoconductive layers.

10 Claims, 1 Drawing Sheet

ELECTROPHOTOGRAPHIC MATERIAL HAVING AN AMORPHOUS SILICON PHOTOCONDUCTIVE LAYER, AN INTERMEDIATE LAYER AND A SURFACE LAYER

FIELD OF THE INVENTION

The present invention relates to an electrophotographic light-sensitive material and more particularly to an electrophotographic light-sensitive material in which amorphous silicon is used in a light-sensitive layer.

BACKGROUND OF THE INVENTION

Electrophotography is a method in which an electrostatic latent image is formed by charging a light-sensitive material and then imagewise exposing, and after development with a developer, the resulting toner image is transferred to a transferring paper and fixed to obtain a copied material. The light-sensitive material to be used in this electrophotographic method basically comprises an electrically conductive substrate and a light-sensitive layer laminated thereon. Amorphous silicon is known as a material constituting the light-sensitive layer, and in recent years, various attempts have been made to improve the amorphous silicon. A light-sensitive material using the amorphous silicon is produced by forming an amorphous film of silicon on the electrically conductive substrate through glow discharge decomposition of silane ($SiH_4$), for example. In this material, a hydrogen atom is incorporated in the amorphous silicon film and, therefore, the material exhibits good photoconductivity. In the amorphous silicon light-sensitive material, the light-sensitive layer has features that a surface hardness is high, abrasion resistance is excellent, heat resistance is high, electrical stability is excellent, range of spectral sensitivity is broad, and light sensitivity is high; it has ideal properties as an electrophotographic light-sensitive material.

Although the amorphous silicon light-sensitive material has excellent characteristics as described above, it has disadvantages in that dark resistance is relatively low, and thus dark decay of the light-sensitive layer is large and even if the material is charged, no sufficiently high charged potential can be obtained. That is, the amorphous silicon light-sensitive material suffers from disadvantages that when the material is charged and imagewise exposed to from an electrostatic latent image, and then the latent image thus formed is developed, electric charges on the surface of the material are decayed until the imagewise exposure, or until the developing step, electric charges on areas where light is not irradiated are decayed and, as a result, necessary charged potential for development can be obtained only with difficulty.

The decay of the charged potential is greatly influenced by circumstances. Particularly under high temperature, high humidity circumstances, the charged potential is seriously decreased. Moreover in repeated use of the light-sensitive material, the charged potential is gradually decreased. In production of copies by the use of the electrophotographic light-sensitive material in which the dark decay of charged potential is large, there are obtained only such copies that an image density is low and reproductivity of intermediate tone is poor.

In order to overcome the above problems, a method has been proposed in which a photoconductive layer of amorphous silicon is formed, and on this layer, amorphous silicon carbide, amorphous silicon nitride, or amorphous silicon oxide, for example, is formed by a plasma CVD method, thereby providing a charge blocking layer which is also to act as a surface protective layer.

However, in the amorphous silicon light-sensitive material with the above surface layer provided thereon, image blur occurs by repeating a copying operation. This phenomenon occurs seriously particularly under high humidity conditions; thus the light-sensitive material cannot be used for the usual electrophotographic process.

Moreover, although the amorphous silicon produced by the plasma CVD (chemical vapor deposition) method has a high surface hardness, it is broken more easily than a selenium-based light-sensitive film or an organic light-sensitive film, and is poor in impact resistance. Thus the light-sensitive material using the amorphous silicon as a main component is scratched by a paper-peeling click, for example, in a copying machine and a printer; as a result, white or black spots are readily formed on copied images.

The amorphous silicon light-sensitive material has hemispheric defects with a diameter of 1 to 30 μm on the surface of the light-sensitive layer. In repeating of the copying operation, electric or mechanical breakage occurs at the above defect parts, thereby producing white or black sports on the image and reducing the quality of the image.

SUMMARY OF THE INVENTION

The present invention is to overcome the aforementioned problems of the amorphous silicon light-sensitive material.

An object of the present invention is to provide an electrophotographic photoreceptor using an amorphous silicon light-sensitive material, which is decreased in dark decay of charged potential.

Another object of the present invention is to provide an electrophotographic photoreceptor using an amorphous silicon light-sensitive material, which is excellent in mechanical strength and does not produce defects on images.

Another object of the present invention is to provide an electrophotographic photoreceptor using an amorphous light-sensitive material, which does not produce image blur under high humidity conditions and can be used in the usual electrophotographic process.

Another object of the present invention is to provide an electrophotographic photoreceptor which can form images freed of moire even in a laser printer using a coherent light source.

It has been found that an amorphous film containing silicon, nitrogen and carbon as major components as produced by the plasma CVD method, when present on the surface, is thermally and mechanically stable, and that the amorphous film is unstable in respect of oxidation as compared with other substances even though it is stable photoelectrically in the electrophotographic process, and an oxidation film formed thereon is more active than a film of an organic or inorganic high molecular weight substance in respect of adsorption of water and a corotron product. It has further been discovered that the breakage of film defects which is considered to be determinant of the service life of the amorphous silicon light-sensitive material can be prevented by dispersing an ion flow from the corotron in the film, that is, by preventing concentration of the ion flow into the film defects.

The present invention relates to an electrophotographic photoreceptor comprising an electrically conductive substrate having thereon at least a photoconductive layer and a surface layer in this order, wherein the photoconductive layer is made mainly of amorphous silicon containing hydrogen, the surface layer is made of an organic or inorganic high molecular weight substance with electrically conductive metal oxide fine powder dispersed therein, said powder preferably having an average particle diameter of not more than 0.3 μm, and between the surface layer and the photoconductive layer, as an intermediate layer, at least one layer made mainly of amorphous silicon carbide, amorphous silicon nitride, amorphous silicon oxide or amorphous carbon each containing hydrogen is provided.

DETAILED DESCRIPTION OF THE INVENTION

Figure 1:
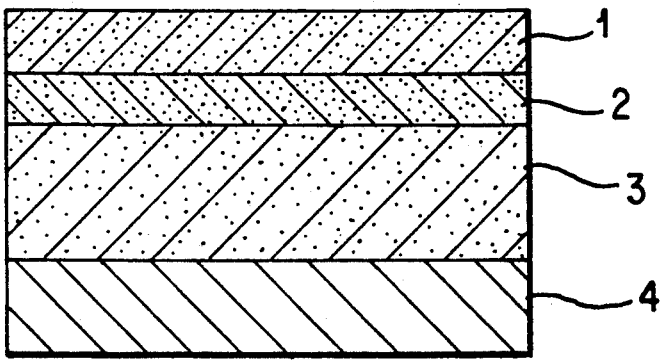
FIG. 1 is a schematic cross-sectional view illustrating a layer structure of an electrophotographic photoreceptor of the present invention.

Referring to the accompanying drawings, FIG. 1 is a schematic cross-sectional view illustrating a layer structure of an electrophotographic photoreceptor of the present invention wherein reference numeral 1 indicates a surface layer in which electrically conductive metal oxide fine powder is dispersed in an organic or inorganic high molecular weight substance, 2 indicates an intermediate layer, 3 indicates a photoconductive layer made mainly of amorphous silicon, and 4 indicates an electrically conductive substrate.

Figure 2:
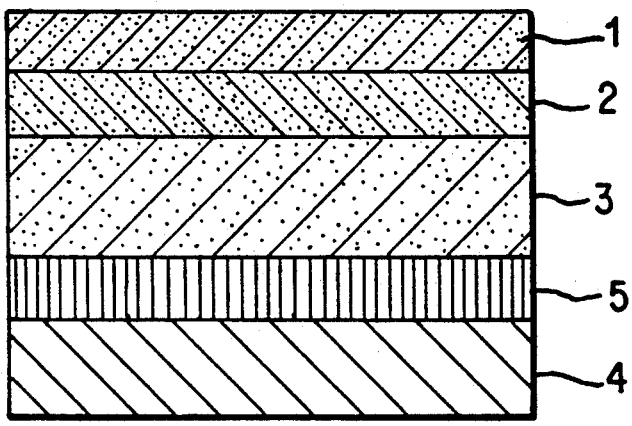
FIG. 2 is a schematic cross-sectional view illustrating a layer structure of another electrophotographic photoreceptor of the present invention.

FIG. 2 is a schematic cross-sectional view of another electrophotographic photoreceptor of the present invention wherein a charge blocking layer 5 is provided between the photoconductive layer 3 and the electrically conductive substrate 4.

In the electrophotographic photoreceptor material of the present invention, the surface layer acts as a charge blocking layer in charging operation, which prevents injection of charges from the surface portion of the photoconductive layer into the inside, and at the same time, acts as a surface protective layer which prevents oxidative molecules generally contained in the atmosphere, such as oxygen, steam, water in the air and ozone, from coming into direct contact with the surface of the photoconductive layer or being adsorbed thereon. Furthermore, the surface layer acts as a surface protective layer which prevents characteristics of the photoconductive layer from being reduced by the action external factors such as application of stress and attachment of reactive chemical substances.

Moreover, the surface layer acts as a layer to prevent film-constituting atoms generally contained in the photoconductive layer, such as hydrogen, from being released from the photoconductive layer.

To the electrophotographic photoreceptor of the present invention, the so-called Carlson method involving charging and imagewise exposing to light is applied and, therefore, it is necessary that surface layer is made low insulative, thereby preventing accumulation of charges on the surface of the surface layer or in the inside thereof. However, if electric conductivity is too high, movement of charges in the width direction occurs, resulting in blurring of images. On the other hand, if electric conductive is too low, charges are accumulated, resulting in blurring of images. Accordingly the electric conductivity of the surface layer should be controlled to an appropriate value and furthermore the electric conductivity should be stable against external influences such as temperature and humidity. Moreover, since the photoreceptor is used according to the Carlson method, the surface layer should be satisfactory in respect of mechanical strength. Substances to be added in order to make the surface layer low insulative should not cause coloring of the surface layer and exert undesirable influences onto spectral sensitivity of the photoreceptor.

The surface layer is formed on the intermediate layer by coating with a solution prepared by dispersing electrically conductive metal oxide fine particles in a binder, or by extending the solution to form a film and then bonding the film.

Electrically conductive metal oxide fine powder to be dispersed in the surface layer preferably has average particle diameter of not more than 0.3 μm and especially 0.05 to 0.3 μm. Electrically conductive metal oxide fine powder that can be used includes fine powders of zinc oxide, titanium oxide, tin oxide which may be doped with 1 to 70 wt % of antimony, antimony oxide, indium oxide which may be doped with 1 to 70 wt % of tin, bismuth oxide, and zirconium oxide. Of these, tin oxide and indium oxide are preferred.

The metal oxide fine powder is generally contained in an amount of 5 to 60 wt %, preferably 10 to 55 wt %, based on the weight of the surface layer. The metal oxide fine powder may be used singly or as mixtures comprising two or more thereof. When used as a mixture comprising two or more, they are used in the form of solid solution or melt.

As the organic high molecular weight substance to be used as a binder of the surface layer, either electrically active polymers (i.e., having a charge transporting property or photoconductive property) such as polyvinyl carbazole or electrically inert polymers (i.e., having neither a charge transporting property nor photoconductive property) can be used. Polymeric materials which can be used include polyvinyl carbazole, an acryl resin, a polycarbonate resin, a polyester resin, a vinyl chloride resin, a fluorine resin, a polyurethane resin, an epoxy resin, an unsaturated polyester resin, a polyamide resin, and a polyimide resin. Of these, curing-type resins are preferred from viewpoints of mechanical strength and adhesive properties.

When an organic polymeric material is used as a binder resin, it is dissolved or dispersed in a solvent, and the resulting solution or dispersion, after adjustment in viscosity, is coated on the intermediate layer by a spray method or a dip method, and then dried or dry-cured to thereby form a surface layer.

In order to improve dispersibility, adhesive properties or lubricity, various additives may be added to the surface layer, such as silicon oxide, aluminum oxide, silane coupling agents, and titanium coupling agents described in S. J. Monte and G. Sugerman, *Modern Paint and Coatings*, p.44 (April 1980).

As the inorganic high molecular weight substance, a silicone resin and inorganic polymeric compounds formed from organic metal compounds as described below can be used.

When the inorganic high molecular weight substance is a liquid silicone resin, for example, the above electrically conductive metal oxide powder is dispersed in the silicone resin and the resulting dispersion is coated and then dried.

The inorganic high molecular weight substance, when formed by a gel-sol method, can be formed as follows.

An alkoxide compound, such as $Si(OCH_3)_4$, $Si(OC_2H_5)_4$, $Si(OC_3H_7)_4$, $Si(OC_4H_9)_4$, $Al(OCH_3)_3$, $Al(OC_2H_5)_3$, $Al(OC_4H_9)_3$, $Ti(OC_3H_7)_4$, $Zr(OC_3H_7)_4$, $Ti(OC_3H_7)_4$, $Y(OC_3H_7)_3$, $Y(OC_4H_9)_3$, $Fe(OC_2H_5)_3$, $Fe(OC_3H_7)_3$, $Fe(OC_4H_9)_3$, $Nb(OCH_3)_5$, $Nb(OC_2H_5)_5$, $Nb(OC_3H_7)_5$, $Ta(OC_3H_7)_5$, $Ta(OC_4H_9)_4$, $Ti(OC_3H_7)_4$, $V(OC_2H_5)_3$, $V(OC_4H_9)_3$ or an organic metal complex such as iron tris(acetylacetonate), cobalt bis(acetylacetonate), nickel bis(acetylacetonate) or a copper bix(acetylacetonate) is dissolved in an alcohol and hydrolyzed while stirring. In the resulting sol solution, the above electrically conductive metal oxide fine powder is dispersed, and the dispersion thus obtained is coated on the intermediate layer by a spray method or a dip method and, after removal of the solvent, heat dried at 50 to 300° C. for 1 to 24 hours. With respect to the gel-sol method, reference can be made to U.S. Pat. application Ser. No. 07/501,841 filed Mar. 30, 1990.

The thickness of the surface layer is not critical; it is generally not more than 20 μm and preferably form 0.1 to 10 μm. If the thickness is more than 20 μm, residual potential after exposure to light tends to be high. On the other hand, if it is less than 1 μm, the mechânical strength is sometimes not sufficiently high and the characteristics of the amorphous silicon light-sensitive material cannot be sufficiently exhibited in some cases.

Between the surface layer and the photoconductive layer, the intermediate layer is provided. This intermediate layer acts to reduce influences of surface oxidation on the surface layer and to prevent injection of charges from the surface layer.

The intermediate layer should be at least one layer made mainly (i.e., 50 to 100 atomic% thereof) of amorphous silicon carbide, amorphous silicon nitride, amorphous silicon oxide or amorphous silicon carbide each containing hydrogen. Other components of the intermediate layer may be halogen (e.g., F, Cl, I, etc.), and elements of Group III or V of the Periodic Table (e.g., B, Al N, P, As, etc.)

The intermediate layer formed particularly by the plasma CVD method is preferred in that it is excellent adhesion properties and productivity.

In formation of the above silicon film by the plasma CVD method, as the starting material for silicon, silanes and high silanes are used, including $SiH_4$, $Si_2H_6$, $SiCl_4$, $SiHCl_3$, $SiH_2Cl_2$, $Si(CH_3)_4$, $Si_3H_8$ and $Si_4H_{10}$.

As the starting material for carbon which mainly constitutes the amorphous silicon carbide or amorphous carbon, aliphatic hydrocarbons such as paraffin hydro carbons represented by the general formula $C_nH_{2m+2}$ (e.g., methane, ethane, propane, butane, and pentene), olefin hydrocarbons represented by the general formula $C_nH_{2n}$ (e.g., ethylene, propylene, butylene and pentene), and acetylene hydrocarbons represented by the general formula $C_nH_{2n-n}$ (e.g., acetylene, allylene and butyne); alicyclic hydrocarbons such as cyclopropane, cyclobutane, cyclopentane, cyclohexane, cyclopetane, cyclobutine, cyclopentene, and cyclohexene; and aromatic hydrocarbons such as benzene, toluene, xylene, naphthalene and anthrathene can be used.

These hydrocarbons may be halogen-substituted. For example, carbon tetrachloride, chloroform, carbon tetrafluoride, trifluoromethane, chlorotrifluoromethane, dichlorofluoromethane, bromotrifluoromethane, fluoroethane, perfluoropropane, etc. can be used.

In the amorphous silicon nitride, as the starting material for nitrogen, gaseous or gasifiable nitrogen compounds such as nitrogen, nitrides and azides, e.g., nitrogen, ammonia, hydrazine, hydrogen azide ($HN_3$) and ammonium azide ($NH_4N_3$) can be used.

In the amorphous silicon oxide, as the starting material for oxygen, those capable of introducing oxygen can be used, including oxygen, ozone, carbon monoxide, carbon dioxide, nitrogen monoxide, nitrogen dioxide, dinitrogen trioxide, dinitrogen tetraoxide, dinitrogen pentaoxide, nitrogen trioxide, tetramethoxysilane ($Si(OCH_3)_4$), and tetraethoxy silane ($Si(OC_2H_5)_4$).

The aforementioned starting material may be gas, solid or liquid at ordinary temperature, The starting material, when solid or liquid, is introduced into a reaction chamber after gasification.

The intermediate layer may be a single layer, or may be a laminate of films containing different elements. The distribution of element in the intermediate layer may be uniform or ununiform. When the distribution of element is ununiform, there may be either uncontinuous changes or continuous changes.

In connection with conditions for formation of the intermediate layer according to the plasma CVD method, in the case of AC discharge for example, they are as follows.

The frequency is usually 0.1 to 30 MHz and preferably 5 to 20 MHz, the degree of vacuum at the time of discharging is 0.1 to 5 Torr (1.33 to 66.7 $N/m^2$), and the substrate heating temperature is 100° to 400° C.

The thickness of the intermediate layer is 0.05 to 10 μm and preferably 0.1 to 5 μm. If the thickness of intermediate layer is less than 0.05 μm, charge preventing properties are poor, and if it is more than 10 μm, the residual potential is high and the sensitivity is decreased.

The photoconductive layer made mainly of amorphous silicon can be formed on the electrically conductive substrate by a technique such as glow discharging, sputtering, ion plating or vacuum deposition. In accordance with the method of decomposing silane ($SiH_4$) gas by glow discharge according to the plasma CVD method (glow discharging method) among the aforementioned methods, there can be obtained a photoconductive layer which contains automatically an appropriate amount of water, has relatively high dark resistance, and has high light sensitivity. That is, a photoconductive layer having the most suitable characteristics for an electrophotographic photoreceptor can be obtained. In this case, for more efficient introduction of hydrogen, hydrogen gas may be introduced into the plasma CVD apparatus along with the silane gas.

As the starting material gas for the amorphous silicon, as well as silane, $SiH_4$, $Si_2H_6$, $Si_3H_8$, $Si_4H_{10}$, $SiCl_4$, $SiF_4$, $SiHF_3$, $SiH_2F_2$ and $SiH_3F$ can be used as silicon hydroxide compounds.

In the present invention, on the photoconductive layer made mainly of amorphous silicon, other elements may be further incorporated. For example, for the purpose of controlling dark resistance of the amorphous silicon photoconductive layer or controlling charged polarity, addition (doping) of impurity elements, e.g., elements of Group III or V of the Periodic Table, such as boron and phosphorus, can be carried out. Examples of the starting materials for addition of Group III or Group V elements are $B_2H_6$, $B_4H_{10}$, $BF_3$, $BCl_3$, $PH_3$, $P_2H_4$, $PF_3$, and $PCl_3$.

For the purpose of increasing the dark resistance of the film, the light sensitivity or chargeability (chargeability or charged potential per unit film thickness), a halogen atom, a carbon atom, an oxygen atom, a nitrogen atom, etc. may be incorporated into the amorphous silicon film.

Furthermore, for the purpose of increasing the sensitivity in the long wavelength region, elements such as germanium can be added to the photoconductive layer. Examples of the starting materials for use in addition of Ge are $GeH_4$, $Ge_2H_6$, $Fe_3H_3$, $Ge_4H_{10}$, $Ge_5H_{12}$, $GeF_4$, and $GeC_{14}$.

In order to incorporate elements other than hydrogen into the amorphous silicon photoconductive layer, it is sufficient that in the plasma CVD apparatus, gasified products of the elements are introduced along with silane gas as the main starting material, which are then subjected to glow discharge decomposition.

Effective discharging conditions for the method of forming the amorphous silicon photoconductive layer in which the silane ($SiH_4$) gas is subjected to glow discharge decomposition according to the plasma CVD method, that is, effective conditions for formation of the amorphous silicon film are as follows: in the case of AC discharging, for example, the frequency is usually 0.1 to 30 MHz, and preferably 5 to 20 MHz, the degree of vacuum at the time of discharging is 0.1 to 5 Torr (1.33 to 66.7 $N/m^2$), and the substrate heating temperature is 100° to 400° C.

The thickness of the photoconductive layer made mainly of amorphous silicon is not critical; it is preferably 1 to 200 μm and more preferably 10 to 100 μm.

In the present invention, as the electrically conductive substrate, both an electrically conductive support and an electrically insulative support can be used. As the electrically conductive support, those substrates made of metals such as aluminum, stainless steel, nickel and chromium, and their alloys, or intermetal compounds can be used.

As the insulative support, polymer films or sheets such as polyester, polyethylene, polycarbonate, polystyrene, polyamide and polyimide, or glass, ceramics, etc. can be used. When the insulative support is used, it is necessary that at least the surface of the support to come into contact with other layer be made electrically conductive, for example by attaching gold, silver, copper, etc., as well as the aforementioned metals, by way of vacuum deposition, sputtering and ion plating.

Irradiation with electromagnetic waves of the electrophotographic photoreceptor of the present invention can be carried out from the electrically conductive substrate side or from the opposite side relative to the electrically conductive substrate. When the irradiation is carried out from the electrically conductive substrate side, the electrically conductive substrate should be permeable to the electromagnetic waves applied. For example, when a metal layer is formed to make the substrate electrically conductive, the thickness of the metal layer is adjusted so that it is permeable to the electromagnetic waves. It is also possible to use a transparent electrically conductive film such as ITO.

The electrically conductive substrate can be in any desired form, such as cylindrical or in an endless belt form.

In the electrophotographic photoreceptor of the present invention, as illustrated in FIG. 2, the charge blocking layer may be provided between the photoconductive layer and the electrically conductive substrate, if necessary.

The charge blocking layer is properly selected depending on charging polarity of the light-sensitive material, and insulative thin films of p-type amorphous silicon doped heavily with a Group III element and films of n-type amorphous silicon doped heavily with a Group V element can be used for the purpose. Insulative thin films of $SiN_x$ x: 0.3–1.22), $SiO_x$ (x: 0.5–2.0), $Si_{1-x}C_x$ (x: 0.2–0.99) etc., can be used. The insulative film can also be formed in the same manner as for formation of the above intermediate layer. The thickness of the charge blocking layer is preferably in a range of 0.3 to 10 μm.

In the electrophotographic photoreceptor of the present invention, the surface layer is made of an organic or inorganic high molecular weight substance with electrically conductive metal oxide fine powder dispersed therein. Therefore, unlike the conventional amorphous silicon type electrophotographic photoreceptor having a layer made mainly of amorphous silicon, amorphous silicon carbide, amorphous silicon nitride, amorphous silicon oxide or amorphous carbide each containing provided on the surface of the photoreceptor, the electrophotographic photoreceptor of the present invention has advantages in that blurring of image does not occur even after long term copying, residual potential is low, abrasion resistance and durability are excellent, and image defects such as white or black spots and white streaks are less caused by long term copying.

The electrophotographic photoreceptor of the present invention can be used in devices using coherent light such as infrared semiconductor laser as a light source, and when used in a laser printer, it can provide high quality images in which formation of interference strips in the laser printer is effectively prevented.

The present invention is described in greater detail with reference to the following examples.

EXAMPLE 1

In a capacitive coupling type plasma CVD apparatus permitting formation of an amorphous silicon film on a cylindrical support, a mixture of silane ($SiH_4$) gas, hydrogen ($H_2$) gas, and diborane ($B_2H_6$ ) gas was subjected to glow discharge decomposition to form a charge injection preventing layer having a thickness of about 2 μm on a cylindrical aluminum support. Conditions employed were as follows.

| | |
|---|---|
| Flow rate of 100% silane gas: | 100 $cm^3$/min |
| Flow rate of 100 ppm hydrogen-diluted diborane: | 200 $cm^3$/min |
| Pressure in the reactor: | 0.5 Torr |
| Discharge electric power: | 100 W |
| Discharge frequency: | 13.56 MHz |
| Support temperature: | 250° C. |

In all the examples and comparative examples as described hereinafter, the discharge frequency and the support temperature employed in formation of each layer by the plasma CVD method were the same as above.

After the formation of the charge injection preventing layer, the reactor was fully purged, and then a mixture of silane, hydrogen and diborane gases was introduced thereinto and was subjected to glow discharge decomposition to form a photoconductive layer having a thickness 20 μm on the charge injection preventing layer. Condition employed for this treatment were as follows:

| | |
|---|---|
| Flow rate of 100% silane gas: | 200 $cm^3$/min |
| Flow rate of 100% hydrogen gas: | 180 $cm^3$/min |
| Flow rate of 100 ppm hydrogen-diluted diborane gas: | 2 $cm^3$/min |
| Pressure in the reactor: | 1.0 Torr |
| Discharge electric power: | 300 W |

After the formation of the photoconductive layer, the reactor was thoroughly purged, and then a mixture of silane, hydrogen and ammonia gases was introduced thereinto and was subjected to glow discharge decomposition to form a first intermediate layer having thickness of about 0.3 μm on the photoconductive layer. Conditions for this treatment were as follows.

| | |
|---|---|
| Flow rate of 100% silane gas: | 30 $cm^3$/min |
| Flow rate of 100% hydrogen gas: | 200 $cm^3$/min |
| Flow rate of 100% ammonia gas: | 30 $cm^3$/min |
| Pressure in the reactor: | 0.5 Torr |
| Discharge electric power: | 50 W |

After the formation of the first intermediate later, the reactor was thoroughly purged, and then a mixture of silane, hydrogen and ammonia gases was introduced thereinto and was subjected to glow discharge decomposition to form a second intermediate layer having a thickness of about 0.1 μm on the first intermediate layer. Conditions for this treatment were as follows.

| | |
|---|---|
| Flow rate of 100% silane gas: | 17 $cm^3$/min |
| Flow rate of 100% hydrogen gas: | 200 $cm^3$/min |
| Flow rate of 100% ammonia gas: | 43 $cm^3$/min |
| Pressure in the reactor: | 0.5 Torr |
| Discharge electric power: | 50 W |

Thereafter, a surface layer was formed on the second intermediate layer in the following manner.

| | |
|---|---|
| Tin Oxide/antimony oxide electrically conductive powder (85/15 by weight solid solution; average particle size 0.3 μm) | 14 parts by weight |
| Polyurethane resin ("Retan Clear' produced by Kansai Paint Co., Ltd) | 55 parts by weight |

The above ingredients were mixed in a ball mill for 50 hours and then 7 parts by weight of a curing agent ("Retan Hardener" produced by Kansai Paint Co., Ltd.) was added. The resulting mixture was spray coated and dried at 120° C. for 2 hours to form the surface layer having a thickness of 3 μm.

Observation of the surface layer revealed that the proportion of particles having a diameter of not more than 0.1 μm was 70%, the proportion of particles having a diameter of 0.1 to 0.3 μm was 25% and the proportion of particles having a diameter of not less than 0.3 μm was 5%.

The electrophotographic photoreceptor thus produced was placed on an FX5990 copying machine (produced by Fuji Xerox Co., Ltd.) and evaluated for image quality. The copying machine was operated under three different conditions: 30° C./85% RH, 20° C./50% RH and 10° C./15% RH. These three different conditions are hereinafter collectively referred to as "three conditions".

After the test of 20,000 sheet copying, no image blur was observed under the three conditions. Under the condition of 30° C./85% RH, additional 300,000 sheets were copied, but neither image blur nor fog was observed. In a copied image without application of light exposure, only two white spots having a diameter of less than 0.2 mm were observed as image defects on the areas corresponding to the whole surface of the photoreceptor.

Electrophotographic characteristics of the electrophotographic photoreceptor prepared in this Example were equivalent to those of the photoreceptor prepared in Comparative Example 1 as described hereinafter, except that the residual potential was higher by 30 V than the latter.

The above prepared photoreceptor was placed in a semiconductor laser printer (XP-9 produced by Fuji Xerox Co., Ltd.) and printing was conducted. As a result, high quality images having no moire were obtained.

COMPARATIVE EXAMPLE 1

An electrophotographic photoreceptor was produced in the same conditions as in Example 1 except that the surface layer was not formed.

The electrophotographic photoreceptor was evaluated for image quality in the same manner as and under the same conditions as in Example 1. At the initial stage, sharp images were obtained under the three conditions. After the evaluation of the initial image quality, a test of about 20,000 sheet-copying was conducted under the condition of 20° C./50% RH and, thereafter, the copying test was conducted under the different condition of 30° C./85% RH and the image quality was then evaluated. As a results, serious image blurring was observed.

A drum heater was then placed in the inside of the aluminum cylinder of the photoreceptor and, while heating the cylinder at 45° C., a copying test was further conducted under the condition of 20° C./50% RH to obtain 300,000 sheets. Thereafter, image evaluation was conducted under the three conditions. Neither image blur nor fog were observed, but in a copied image obtained without application of light exposure, one white spot having a diameter of 0.5 mm, two white spots having a diameter of 0.3 mm and five white spots having a diameter of less than 0.2 mm were observed on the areas corresponding to the whole surface of the photoreceptor. Since these white spots were not observed at the initial stage, they were formed by the copying operation.

In addition, a slight white streak was observed on the surface of the photoreceptor at the position of a paper stripping finger.

The photoreceptor prepared in this Comparative Example was placed in a semiconductor laser printer (XP-produced by Fuji Xerox Co., Ltd.). Moire was observed on the whole surface and the image quality was seriously deteriorated.

EXAMPLE 2

A charge injection preventing layer and a photoconductive layer were formed in the same manner as and under the same conditions as in Example 1. Thereafter, in place of the first and second intermediate layers in Example 1, an intermediate layer made of amorphous silicon carbide and having a thickness of 0.2 μm was formed under the following conditions.

| | |
|---|---|
| Flow rate of 100% silane gas: | 40 $cm^3$/min |
| Flow rate of 100% methane gas: | 200 $cm^3$/min |
| Flow rate of hydrogen gas: | 100 $cm^3$/min |
| Pressure in the reactor: | 0.25 Torr |
| Discharge electric power: | 200 W |

On the intermediate layer thus formed, a surface layer of the same composition as in Example 1 was formed in a thickness of 5 μm.

The electrophotographic photoreceptor thus produced was measured for electrophotographic characteristics. It was found that only the residual potential was higher by 50 V, but other properties were equivalent to those of the photoreceptor prepared in Comparative Example 2.

The electrophotographic photoreceptor was evaluated for image quality in the same manner as and under the same conditions as in Example 1. Both at the initial stage and after copying of 20,000 sheets, no image blur was observed under the three conditions.

COMPARATIVE EXAMPLE 2

An electrophotographic photoreceptor was produced in the same manner as in Example 2 except that no surface layer was formed.

The photoreceptor thus obtained was evaluated for image quality in the same manner as and under the same conditions as in Example 2. Although high quality copied images were obtained at the initial stage, image blur was observed after 20,000 sheet-copying under the condition of 30° C./85% RH.

In addition, white streaks considered due to a cleaning blade was observed in a copied image while no scratches were observed on the surface of the photoreceptor.

EXAMPLE 3

An electrophotographic photoreceptor was produced in the same manner as in Example 1 except that a surface layer was formed using Ceramica G-90 (a product of Nichiban Kenkyujo Co., Ltd.) as an inorganic high molecular weight compound, as follows.

| | |
|---|---|
| Ceramica G-90 (produced by Nichiban Kenkyujo Co., Ltd.) | 60 parts by weight |
| Tin oxide/antimony oxide Electrically conductive powder (85/15 by weight solid solution: average particle diameter 0.3 μm) | 12 parts by weight |

These ingredients were mixed in a ball mill for 100 hours, and then a hardener was added thereto. The coating solution thus prepared was coated on the second intermediate layer comprising amorphous silicon nitride by the dip coating method, and dried at 150° C. for 5 hours to form a surface layer having a thickness of 3 μm. In the XPS (X-ray photoelectron spectroscopy) analysis of the film, any component other than silicon oxide, tin oxide and antimony oxide was not detected.

Electrophotographic characteristics of the electrophotographic photoreceptor were measured. The residual potential of the photoreceptor was higher by 10 V than that of the photoreceptor prepared in Comparative Example 1, but other properties were equivalent to those of the latter.

The photoreceptor was evaluated for image quality in the same manner as and under the same conditions as in Example 1. Both at the initial stage and after copying of 20,000 sheets, no image blur was observed under the three conditions. In connection with image defects, only one white spot having a diameter of less than 0.2 mm was observed in a copied image obtained without application of light exposure.

EXAMPLES 4

An electrophotographic photoreceptor was produced in the same manner as and under the same conditions as in Example 1 except that the surface layer was formed using an inorganic high molecular weight substance, as follows.

| | |
|---|---|
| Silicone for protective coating ("X-41-9710H" produced by Shin-Etsu Kagaku Kogyo Co., Ltd.) | 50 parts by weight |
| Tin oxide/antimony oxide electrically conductive powder (85/15 by weight solid solution; average particle diameter 0.3 μm) | 9 parts by weight |

These ingredients were mixed for 50 hours while maintaining at 10° C., and the resulting mixture was spray coated and then dried at 180° C. for 1 hours to form the surface layer having a thickness of 1 μm.

This electrophotographic photoreceptor was measured for electrophotographic characteristics. Only the residual potential thereof was higher by 10 V than that of the photoreceptor prepared in Comparative Example 1, and other properties were equivalent to the latter.

The above photoreceptor was evaluated for image quality in the same manner as and under the same conditions as in Example 1.

Both at the initial stage and even after copying of 20,000 sheets, no image blur was observed under the three conditions. Even after 300,000 sheet-copying was conducted, no image blur was observed. In connection with image defects, only one white spot having a diameter of less than 0.2 nm was observed in a copied image obtained without application of light exposure.

Moreover, no abrasion due to a paper stripping finger was observed on the surface of the photoreceptor.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having thereon at least a photoconductive layer and a surface layer wherein the photoconductive layer is made mainly of amorphous silicon containing hydrogen and the surface layer is made of a high molecular weight binder with an electrically conductive metal oxide powder dispersed therein, and at least one intermediate layer between the photoconductive layer and the surface layer made mainly of a material containing hydrogen wherein the material is amorphous silicon carbide, amorphous silicon nitride, amorphous silicon oxide or amorphous carbon.

2. The electrophotographic photoreceptor as in claim 1, wherein said electrically conductive metal oxide powder has an average particle size of 0.3 μm or less.

3. The electrophotographic photoreceptor as in claim 1, wherein said electrically conductive metal oxide powder is zinc oxide, titanium oxide, tin oxide, antimony oxide, indium oxide, bismuth oxide, or zirconium oxide.

4. The electrophotographic photoreceptor as in claim 1, wherein said binder of the surface layer is a polyvinyl carbazole, an acryl resin, a polycarbonate resin, a polyester resin, a vinyl chloride resin, a fluorine resin, a polyurethane resin, an epoxy resin, an unsaturated polyester resin, a polyamide resin, or a polyimide resin.

5. The electrophotographic photoreceptor as in claim 1, wherein said binder of the surface layer is derived from a alkoxide compound or an organic metal complex.

6. The electrophotographic photoreceptor as in claim 1, wherein said surface layer has a thickness of 0.1 to 20 μm.

7. The electrophotographic photoreceptor as in claim 1, wherein said electrically conductive metal oxide powder is contained in an amount of 5 to 60 wt % based on the weight of the surface layer.

8. The electrophotographic photoreceptor as in claim 1, wherein said intermediate layer has a thickness of 0.05 to 10 μm.

9. The electrophotographic photoreceptor as in claim 1, wherein said photoconductive layer has a thickness of 1 to 200 μm.

10. The electrophotographic photoreceptor as in claim 1, which further comprises an charge blocking layer provided between the substrate and the photoconductive layer.

* * * * *